US006953191B2

(12) United States Patent
Landwehr et al.

(10) Patent No.: US 6,953,191 B2
(45) Date of Patent: Oct. 11, 2005

(54) DEPOSIT DEVICE FOR A STACK OF SHEETS

(75) Inventors: Martin Landwehr, Paderborn (DE); Waldemar Jäger, Paderborn (DE); Heiner Stukenberg, Salzkotten (DE)

(73) Assignee: Wincor Nixdorf International GmbH, Paderborn (DE)

( * ) Notice: Subject to any disclaimer, the term of this patent is extended or adjusted under 35 U.S.C. 154(b) by 166 days.

(21) Appl. No.: 10/467,240

(22) PCT Filed: Jan. 15, 2002

(86) PCT No.: PCT/DE02/00088

§ 371 (c)(1),
(2), (4) Date: Aug. 6, 2003

(87) PCT Pub. No.: WO02/062691

PCT Pub. Date: Aug. 15, 2002

(65) Prior Publication Data

US 2004/0051235 A1 Mar. 18, 2004

(30) Foreign Application Priority Data

Feb. 6, 2001 (DE) ..... 101 05 242

(51) Int. Cl.[7] ..... B65H 29/38
(52) U.S. Cl. ..... 271/177; 271/219
(58) Field of Search ..... 271/177, 219

(56) References Cited

U.S. PATENT DOCUMENTS 4,807,866 A 2/1989 Stemmle
4,830,351 A 5/1989 Stanislaw
5,116,037 A 5/1992 Gerlier et al.
5,139,149 A * 8/1992 Gerlier ..... 209/534
5,282,612 A 2/1994 Gerlier
5,569,015 A * 10/1996 Gerlier ..... 414/790.7
5,711,649 A 1/1998 Gerlier
6,244,589 B1 * 6/2001 Gerlier ..... 271/177

FOREIGN PATENT DOCUMENTS

EP 0 470 329 A1 4/1991
EP 0 747 866 A1 12/1996

* cited by examiner

*Primary Examiner*—Donald P. Walsh
*Assistant Examiner*—Kenneth W. Bower
(74) *Attorney, Agent, or Firm*—Michael-Duffy Group LLP

(57) ABSTRACT

A device for depositing sheets in the form of a stack, comprises a housing with a deposit surface, arranged in the latter such that its height can be adjusted, for holding a sheet stack, a stacking mechanism with a roller which is aligned parallel to the deposit surface and can be displaced from a first end of the deposit surface in the direction of the second end of the deposit surface, parallel to the latter, and with at least one belt, one end of which is fixed to the housing close to the first end of the deposit surface and, starting from the fixing point, is led around the roller and parallel to the deposit surface to a belt storage means, a second roller which is arranged parallel to the first roller and at a radial distance from the latter, can be displaced together with the first roller parallel to the deposit surface and at least a second belt, one end of which is fixed to the housing close to the second end of the deposit surface and, starting from the fixing point, is led parallel to the deposit surface and around the second roller to a second belt storage means, guide surfaces for the sheets to be deposited being arranged in the roller gap.

14 Claims, 3 Drawing Sheets

DEPOSIT DEVICE FOR A STACK OF SHEETS

CROSS-REFERENCE TO RELATED APPLICATIONS

This application is entitled to the benefit of and incorporates by reference essential subject matter disclosed in International Application No. PCT/DE02/00088 filed on Jan. 15, 2002 and German Patent Application No. 10105242.1 filed on Feb. 6, 2001.

FIELD OF THE INVENTION

The invention relates to a device for depositing sheets, in particular banknotes or check forms, in the form of a stack, comprising a housing with a deposit surface arranged in the latter such that its height can be adjusted, for holding a sheet stack, a stacking mechanism with a roller which is aligned parallel to the deposit surface and can be displaced from a sheet pick-up position close to a first end of the deposit surface in the direction of the second end of the deposit surface, parallel to the latter, and with at least one belt, one end of which is fixed to the housing close to the first end of the deposit surface and, starting from fixing point, is led around the roller, parallel to the deposit surface, to a belt storage means, and sheet guiding means for feeding in a sheet to be deposited in such a way that its leading end strikes the deposit surface close to the first end thereof or strikes the surface of the stack.

BACKGROUND OF THE INVENTION

A device of the above-mentioned type is disclosed, for example, by EP 0 747 866 B. In the solution described there, the sheet to be deposited is transported by feed rollers to the deposit surface or to the surface of the stack. At the end of the deposit surface or the stack which corresponds to the sheet pick-up position of the roller, a gripper is arranged, which presses the leading end of the sheet to be deposited against the deposit surface or the surface of the stack and therefore holds the sheet to be deposited firmly such that it cannot move. The roller then rolls the sheet to be deposited onto the deposit surface or the respective surface of the stack. As the roller returns into its sheet pick-up position, the roller displaces the gripper again into its opening position, in which a new sheet can be pushed with its leading end under the gripper. If, therefore, the roller is located in its sheet pick-up position, the sheets lying loosely on one another would not be secured against slipping. In order to hold the sheets firmly on the deposit surface even during this time, in the case of the known device flexible pressing elements such as brushes or leaf springs are arranged above the sheet stack, against which the sheet stack is pressed from below and which, when a sheet is being deposited, are pushed to the side by the roller moved over the surface of the sheet stack. This solution is relatively complicated, susceptible to faults and needs a relatively great deal of space.

The invention is based on the object of specifying a device of the type mentioned at the beginning which, with simple means, permits fault-free deposition of the individual sheets on the deposit surface or the surface of the stack and firm holding of the deposited sheets on the deposit surface.

According to the invention, this object is achieved in that the stacking mechanism comprises a second roller which is arranged parallel to the first roller and at a radial distance from the latter, can be displaced together with the first roller parallel to the deposit surface and has at least a second belt, one end of which is fixed to the housing close to the second end of the deposit surface and, starting from the fixing point, is led parallel to the deposit surface and around the second roller to a second belt storage means, and in that the sheet guiding means arranged in the roller comprises first and second guide surfaces for the sheets to be deposited.

SUMMARY OF THE INVENTION

When the two rollers are in the sheet pick-up position, the second belt extends over the surface of the stack and thus holds the sheets of the stack firmly during this time. If a further sheet is deposited on the deposit surface or the surface of the stack, it is guided in the roller gap and is rolled onto the surface of the stack by the first roller together with the first belt, as has already also been described in the prior art. When the two rollers return to the sheet pick-up position, the second belt is in turn laid over the surface of the stack, so that at any time the sheets lying on the deposit surface are held firmly by one of the belts or both belts.

The two rollers are preferably mounted on a carriage which is guided on the housing such that it can be moved parallel to the deposit surface.

The respective belt storage means is expediently a storage spool, on which the belt is wound up or from which it is unwound when the respective roller moves over the surface of the stack. Since, during the to and fro movement of the two rollers, one belt is always wound up and the other belt is unwound, and thus one coil diameter increases while the other decreases, the storage spools would have to be driven at different rotational speeds, in order that the respective unwound length of one belt corresponds to the respective wound-up length of the other belt. However, this would be a relatively complicated solution. According to the invention, therefore, it is proposed that the storage spools in each case be mounted on a winding shaft, that one of the winding shafts be coupled to a drive motor and, via a gear mechanism, to the other winding shaft, and that the storage spools be prestressed in the respective winding direction. This offers the possibility of driving both winding shafts at the same speed with a single drive motor and compensating for the length differences which occur during winding and, respectively, unwinding of the belts via the spring prestress of the storage spools. As can be seen, in this solution, no drive motor is needed for the roller carriage either. The roller carriage is in each case pulled by the belt which is currently being wound up.

The gear mechanism which couples the two winding shafts to each other is preferably a belt drive, for example a toothed belt. The roller carriage is expediently guided on side walls of the housing, it being possible for the end positions of the roller carriage to be determined by limit switches which control the drive motor.

A sheet sensor that monitors the roller gap is preferably provided, which determines whether a sheet to be deposited has arrived in the roller gap and, with a certain time delay, switches on the drive motor in order to initiate the deposition procedure. The time delay is necessary in order that the leading end of the sheet, after entering the roller gap, has arrived as far as the first end of the deposit surface or the sheet stack, so that the sheets can be laid on one another with their edges flush. Such a sheet sensor can be implemented in a simple way by a light barrier whose light path crosses the roller gap. In order to avoid electric feed lines to the movable carriage, the optical transmitter and the optical receiver of the light barrier are arranged fixed to the housing close to the first end of the deposit surface and are aimed at a light deflection element, which is arranged on the roller carriage on the other side of the roller gap—as viewed from the optical transmitter and the optical receiver. As long as there is no sheet in the roller gap, the light deflection element returns the light beam originating from the optical transmitter to the optical receiver. This light path is interrupted by a sheet entering the roller gap, so that as a result a switching operation can be triggered.

The light deflection element can be an optical prism or a U-shaped optical conductor, whose U legs, in the sheet pick-up position of the roller carriage, are aimed at the optical transmitter and the optical receiver, respectively.

The device according to the invention is intended in particular to be connected to a scanner for check forms. In the scanner, check forms are scanned and therefore read. Following reading, they can be deposited in order by means of the stacking device according to the invention. Whether the check forms can be deposited or have to be processed further in another way can be decided only after complete scanning of the check form. For reasons of space, during reading, the check form can already have been pushed partly out through the exit gap of the scanner housing. In order to avoid the check form already getting into the roller gap of the roller carriage of the stacking device in the process and therefore triggering the deposition procedure, according to the invention a sheet guide surface is arranged on the housing above the movement path of the roller carriage and can be displaced between a first position, in which it projects into the feed path of a sheet to the roller gap of the roller carriage, and a second position, in which it opens the feed path. If the deposition of the check form is not yet desired, the sheet guide surface intercepts the sheet emerging from the scanner housing and prevents the sheet entering the roller gap of the roller carriage. From the sheet guide surface, the check form that has been read can be fed to another processing means. However, it can also be pulled back into the scanner in order subsequently to be able to be deposited. For this purpose, the sheet guide surface is then displaced into its second position, in which the feed path to the roller gap of the roller path is open, in order in this way to insert the sheet to be deposited into the roller gap and to trigger the deposition procedure. The displacement of the sheet guide surface can be carried out in a simple way by the sheet guide surface being prestressed into its first position and being displaceable into its second position by the roller carriage.

BRIEF DESCRIPTION OF THE DRAWINGS

Further features and advantages of the invention emerge from the following description which, in conjunction with the appended drawings, explains the invention by using an exemplary embodiment. In the drawings.

DETAILED DESCRIPTION OF THE PREFERRED EMBODIMENTS

Figure 1:
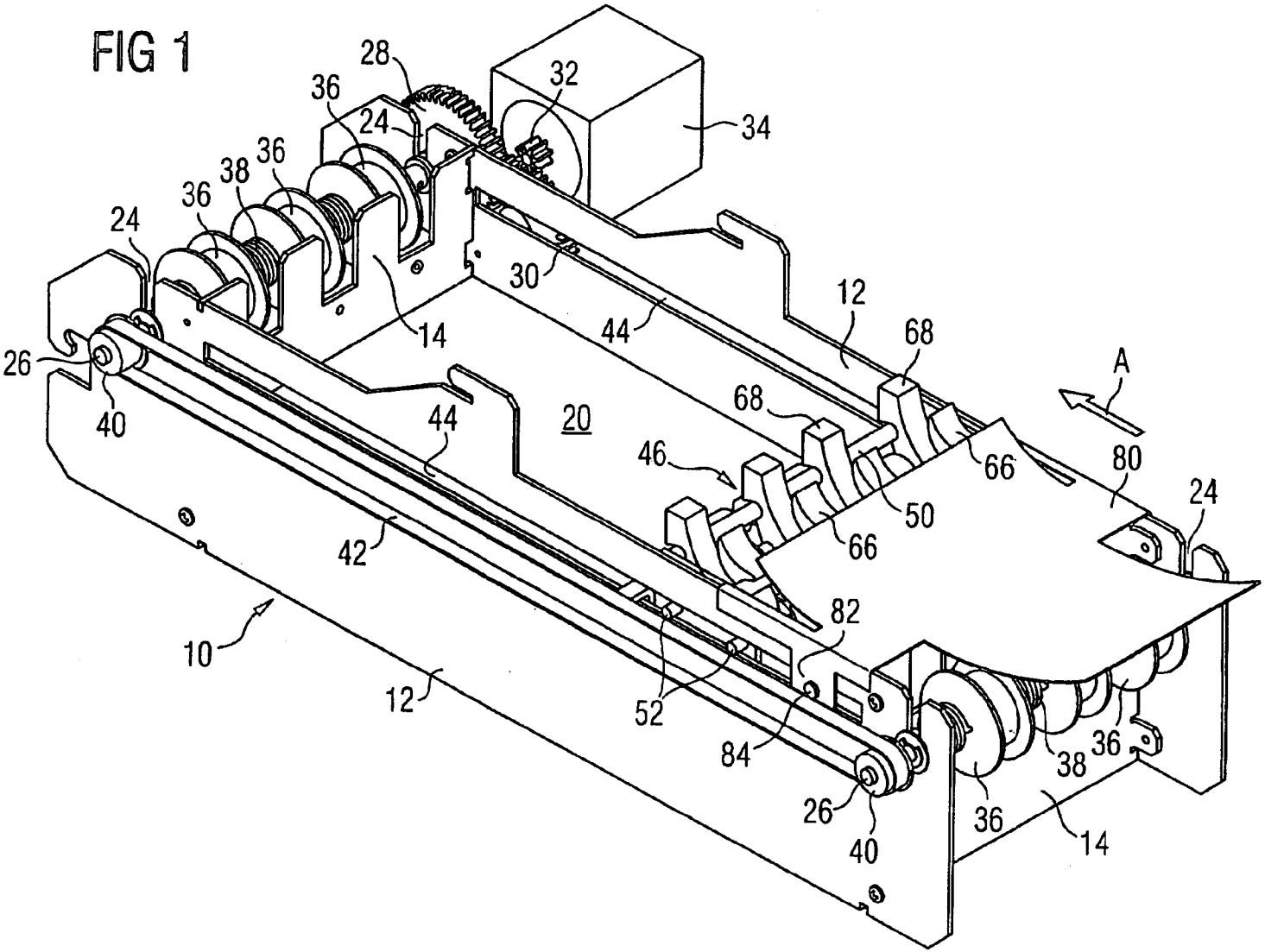
FIG. 1 shows a partly schematic, perspective illustration of a device according to the invention for depositing sheets in the form of a stack.
Figure 3:
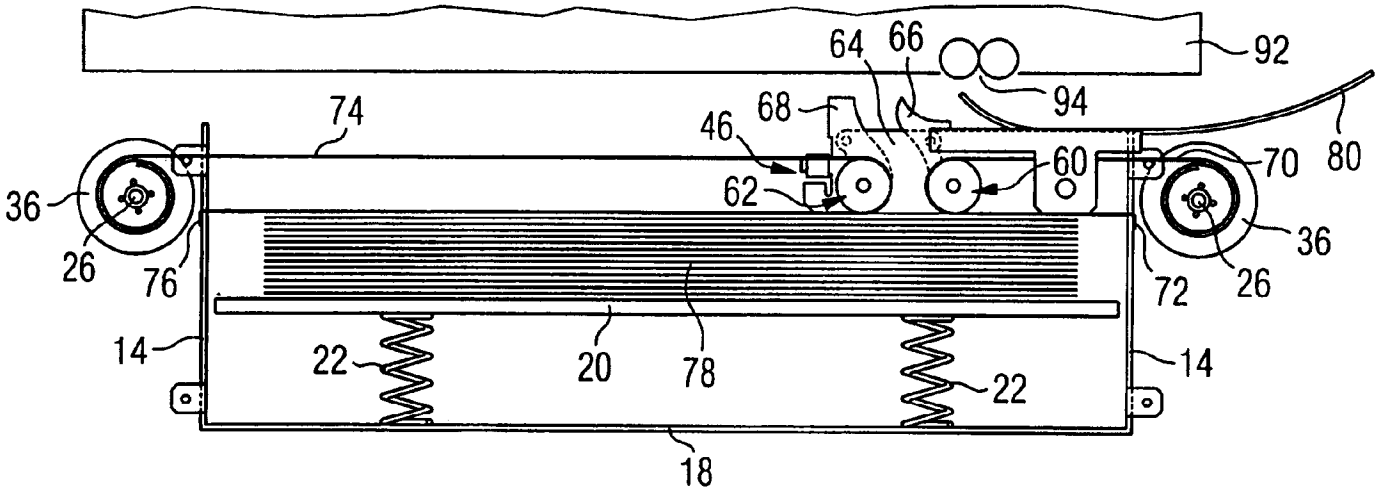
FIG. 3 shows a simplified side view of the elements essential to the function of the device illustrated in FIG. 1 in combination with a sheet output device and with the roller carriage in a first position and FIG. 4 shows a view corresponding to FIG. 3 with the roller carriage in a second position.
Figure 4:
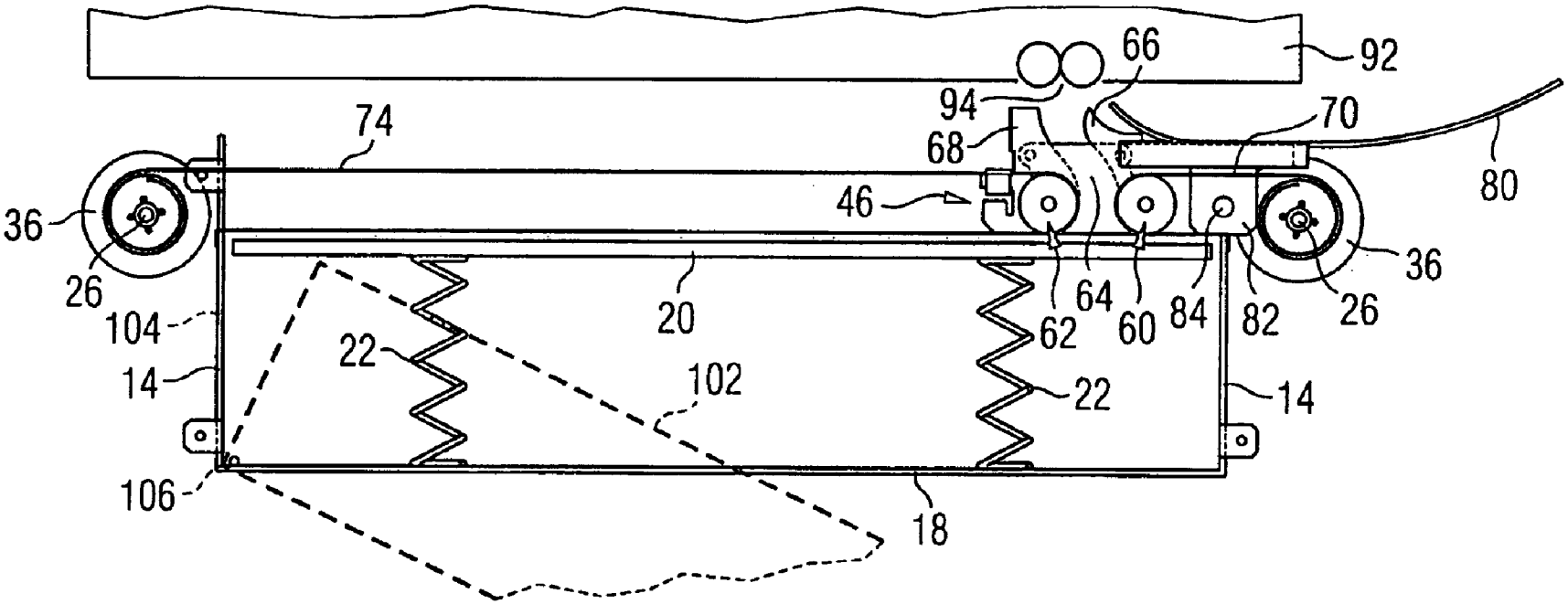

The device illustrated in FIG. 1 for depositing sheets such as banknotes or check forms comprises a frame-like housing 10 with side walls 12, end walls of 14 and a base 18 (FIGS. 3 and 4). Within the housing 10, a deposit surface 20 is arranged parallel to the base 18 and, in a manner not shown, is guided such that its height can be adjusted. The deposit surface 20 is prestressed into an upper end position by springs 22.

The side walls 12 in each case project beyond the end walls of 14. Formed in the projecting sections of the side walls 12 are fork-like incisions 24 which are open at the top and in which a winding shaft 26 is mounted in each case. The left-hand winding shaft in FIG. 1 is connected to the drive pinion 32 of a drive motor 34 via gears 28, 30. For reasons of improved clarity, the motor 34 is illustrated outside the housing 10 in FIG. 1. As a rule, however, it will be accommodated within the housing 10.

Three belt rollers 36 are rotatably mounted on the two winding shaft 26, in each case at axial intervals, and are in each case coupled to the winding shaft 26 by a torsion spring 38. The two winding shafts 26 also bear a pinion 40 in each case, over which there runs a toothed belt 42 that couples the two winding shafts 26, so that the two winding shafts 26 can be driven synchronously by the drive motor 34.

Formed in the side walls 12 in each case is a guide slot 44 aligned parallel with the base 18 of the housing 10. In the guide slot 44, a roller carriage generally designated by 46 is guided such that it can be displaced parallel to the base 18 and to the deposit surface 20. The roller carriage 46 has a frame formed of side walls 48 and connecting rods 50. Arranged on the respective outer side of the side walls 48 are pins 52 which engage in the guide slots 44. Between the side walls 48, parallel to the connecting rods 50, a first shaft 54 and a second shaft 56 spaced radially apart from the latter are mounted. In each case three belt rollers 58 are mounted on the shafts 54 and 56 and together form a first roller 60 and a second roller 62 which bound a roller gap 64 between them. First sheet guiding elements 66 and second sheet guiding elements 68 are arranged axially between the belt rollers 58.

Figure 2:
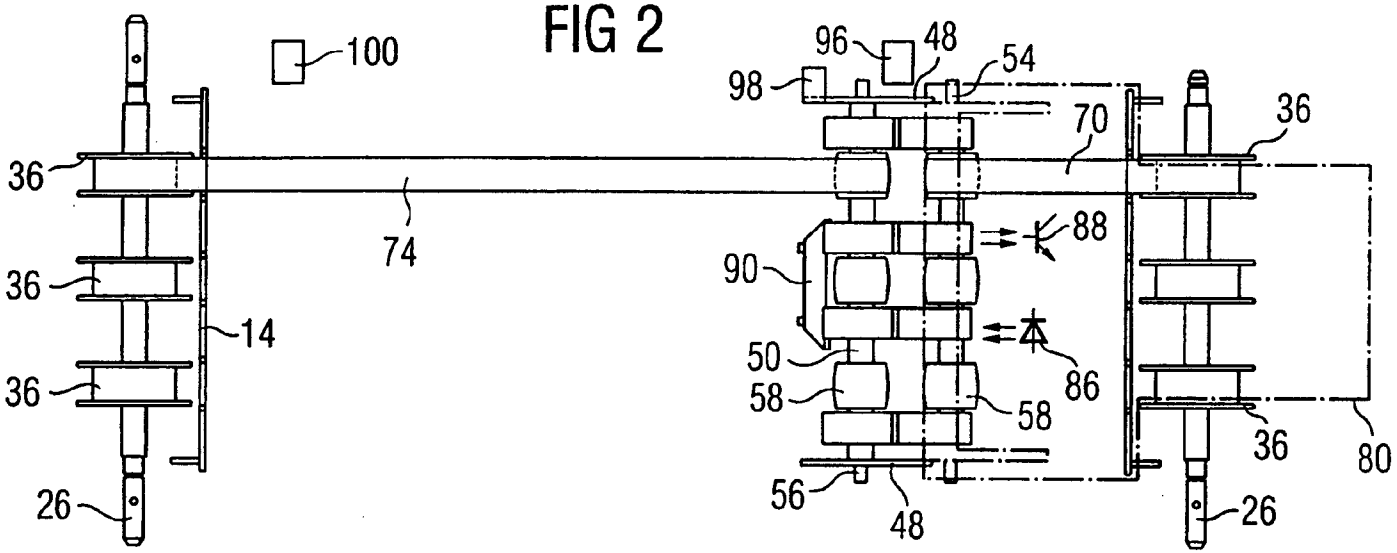
FIG. 2 shows a simplified plan view of the elements essential to the function of the device illustrated in FIG. 1.

Three first belts 70 (of which in each case only one is illustrated in FIGS. 2 and 3) are fixed to the end wall 14 at their one end 72. From there, they firstly extend parallel to the deposit surface 20 as far as the roller carriage 46, around a belt roller 58 of the first roller 60 and back to a storage spool 36, on which the other belt end section is wound up. Likewise, three second belts 74 are provided (of which only one is likewise illustrated in FIGS. 2 and 3), and are fixed to the other end wall 18 by their one end 76, extend from said end wall is far as a belt roller 58 of the second roller 66, around the latter and back again to a storage spool 36, on which the other end section of the belt 74 is wound up.

If the roller carriage 46 moves out of the right-hand end position illustrated in the figures in the direction of the other longitudinal end of the housing 10, then the upper runs of the first belts 70 are unwound from the associated storage spool 36, and the lower runs of the first belts 70 are rolled onto the deposit surface 20 or the surface of a sheet stack 78 formed on the deposit surface 20. Conversely, the upper runs of the second belts 74 are simultaneously wound up onto the associated storage spool 36, while the lower runs of the second belts 74 are lifted off the deposit surface 20 or the surface of the sheet stack 78. If the roller carriage 46 moves in the opposite direction, the first belts 70 are wound up and the second belts 74 are unwound.

The coils on the storage spool 36 are formed in such a way that the first belts 70 and the second belts 74 are always tensioned by the torsion springs which prestress the storage spools 36 in the winding direction. This prestress permits compensation of the length difference between the first belts 70 and the second belts 74 which, during the movement of the roller carriage 46, arises as a result of the fact that the coil diameter on the storage spools 36 for the first belts 70 and the second belts 74 in each case changes in the opposite direction.

From the preceding description, it can also be seen that the roller carriage 46 does not need its own drive, but that one winding shaft 26, which is driven by the motor 34, in turn drives the other winding shaft 26 in the same direction of rotation and at the same rotational speed, the roller carriage 46 being pulled by those belts which are in each case wound up.

Close to the right-hand end of the housing 10 in FIG. 1, above the storage spools 36, a curved sheet guide plate 80 is arranged, which rests on the upper edges of the side walls 12 and has lateral extensions 82 which are curved downward, to which in each case a pin 84 that engages in the respective guide slot 44 is fixed. The sheet guide plate 80 is prestressed in the direction of the arrow A into the position illustrated in FIG. 3 by a spring (not illustrated) and can be displaced counter to this spring prestress by the roller carriage 46 from the end position illustrated in FIG. 3 into the end position illustrated in FIG. 4.

The roller gap 64 of the roller carriage 46 is monitored by a light barrier, by means of which it can be determined whether a sheet to be deposited has entered the roller gap 64. The light barrier comprises a light-emitting diode 86 and a photoreceiver 88, which are both arranged in a manner not illustrated on a carrier fixed to the housing in such a way that the optical transmitting direction and the optical receiving direction are aligned substantially parallel to the direction of movement of the roller carriage 46. On the roller carriage 46 there is a light deflection element in the form of an optical prism 90, which is directed the light originating from the light-emitting diode 86 and passing through the roller gap 64 from the prism 90 through twice times 90° and back again through the roller gap 64 to the photoreceiver 88. This double light path is interrupted by a sheet which is inserted into the roller gap 64, so that the sheet sensor formed by the light barrier 86, 88, 90 can respond to a sheet in the roller gap 64.

In FIGS. 3 and 4, above the housing 10, a device 92 is indicated which outputs sheets to be deposited at an output gap 94. The device 92 can be, for example, a scanner for reading check forms. If a check form is initially only to be read in the device 92, then it is pushed through once completely under the read head, emerging from the exit slot 94 and sliding along on the sheet guide plate 80, which is in the position illustrated in FIG. 3. If the check form is then to be deposited in the housing 10, the roller carriage 46 is transported out of the position illustrated in FIG. 3 into the sheet pick-up position illustrated in FIG. 4, in which the roller gap 64 is aligned with the exit slot 94 of the device 92. This position is defined by a forked light barrier 96 which, in the sheet pick-up position of the roller carriage 46, is interrupted by a flag 98 connected to the roller carriage (FIG. 2). The check form, which has been pulled in in the meantime, is then output through the exit slot 94 of the device 92 again and inserted into the roller gap 64, being guided by the sheet guide elements 66, 68. In the process, it interrupts the light path of the light barrier 86, 88, 90. With a certain time delay, which ensures that the sheet has been pushed into the roller gap 64 until the leading end of the sheet is on the sheet stack or the deposit surface, the roller carriage 46 is then moved to the left in FIG. 1 by switching on the drive motor 34, the sheet to be deposited being rolled by the first belts 70 onto the deposit surface 20 or the upper side of the sheet stack located on the latter, while, at the same time, the second belts 74 are lifted off the deposit surface or the upper side of the stack. Once the roller carriage 46 reaches its left-hand end position in FIG. 1, which is defined by a further forked light barrier 100, the drive motor 34 reverses its drive direction. The roller carriage 46 is pulled back again into the position illustrated in FIG. 3, the lower runs of the second belts 74 being laid on the surface of the sheet just deposited and therefore holding the sheets of the stack 78 firmly on the deposit surface 20.

In order to be able to remove the deposited sheets more easily, the housing 10 can be subdivided into a lower housing part 102 and an upper housing part 104, which are connected to each other by a hinge 106, so that the lower housing part 102 together with the deposit surface 20 and the deposited sheets can be pivoted downward, as imagined in FIG. 4 by dashed lines. The rollers 60, 62, the belts 70, 74 and the belt storage means 36, on the other hand, remain fixed to the upper housing part 104.

What is claimed is:

1. A device for depositing sheets, in particular banknotes or check forms, in the form of a stack, comprising a housing with a deposit surface, arranged in the housing such that the deposit surface height can be adjusted, for holding a sheet stack, a stacking mechanism with a roller which is aligned parallel to the deposit surface and can be displaced from a sheet pick-up position close to a first end of the deposit surface in the direction of a second end of the deposit surface, parallel to the deposit surface, and with at least one belt, one end of which is fixed to the housing close to the first end of the deposit surface and, starting from the fixed end is routed around the roller and parallel to the deposit surface to a belt storage means, and sheet guiding means for feeding in a sheet to be deposited in such a way that its leading end strikes the deposit surface close to the first end thereof or strikes a surface of the stack, characterized in that the stacking mechanism comprises a second roller which is arranged parallel to the first roller and at a radial distance from the latter, can be displaced together with the first roller parallel to the deposit surface and has at least a second belt, one end of which is fixed to the housing close to the second end of the deposit surface and, starting from the fixing point, is routed parallel to the deposit surface and around the second roller to a second belt storage means, the sheet guiding means arranged in a roller gap including first and second guide surfaces for the sheets to be deposited.

2. The device as claimed in claim 1, wherein the two rollers are mounted on a carriage which is guided on the housing such that the can be moved parallel to the deposit surface.

3. The device as claimed in claim 2, wherein the roller carriage is guided on side walls of the housing.

4. The device as claimed in claim 2, wherein a sheet guide surface is arranged on the housing above the movement path of the roller carriage and can be displaced between a first position, in which it projects into the feed path of a sheet to the roller gap of the roller carriage, and a second position, in which it opens the feed path.

5. The device as claimed in claim 4, wherein the sheet guide surface is prestressed into its first position and can be displaced into its second position by the roller carriage.

6. The device as claimed in claim 1, wherein the respective belt storage means is a storage spool, on which the belt can be wound up.

7. The device as claimed in claim 6, wherein the storage spools are in each case mounted on a winding shaft, in that one of the winding shafts is coupled to a drive motor and, via a gear mechanism, to the other winding shaft, and in that the storage spools are prestressed in the respective winding direction.

8. The device as claimed in claim 7, wherein the gear mechanism is a belt drive.

9. The device as claimed in claim 2, wherein the end positions of the roller carriage are determined by limit switches.

10. The device as claimed in claim 1, wherein a sheet sensor that monitors the roller gap is provided.

11. The device as claimed in claim 10, wherein the sheet sensor is a light barrier whose light path crosses the roller gap.

12. The device as claimed in claim 11, wherein the optical transmitter and the optical receiver of the light barrier are arranged fixed to the housing close to the first end of the deposit surface and are aimed at a light deflection element which is arranged on the roller carriage on the other side of the roller gap—as viewed from the optical transmitter and from the optical receiver.

13. The device as claimed in claim 12, wherein the light deflection element is an optical prism or a U-shaped optical conductor, whose U legs, in the sheet pick-up position of the roller carriage, are aimed at the optical transmitter and the optical receiver, respectively.

14. The device as claimed in claim 1, wherein the housing has a lower housing part that contains the deposit surface, and an upper housing part, on which the rollers, the belts and the belt storage means are arranged, and in that the lower housing part is connected to the upper housing part by a hinge.

* * * * *

UNITED STATES PATENT AND TRADEMARK OFFICE

CERTIFICATE OF CORRECTION

PATENT NO. : 6,953,191 B2
DATED : October 11, 2005
INVENTOR(S) : Martin Landwehr et al.

It is certified that error appears in the above-identified patent and that said Letters Patent is hereby corrected as shown below:

Title page,
Item [74], *Attorney, Agent, or Firm*, please delete "Micheal-Duffy Group LLP" and substitute -- Michaud-Duffy Group LLP --.

Signed and Sealed this

Thirteenth Day of December, 2005

JON W. DUDAS
*Director of the United States Patent and Trademark Office*